US005850199A

United States Patent [19]

Wan et al.

[11] Patent Number: 5,850,199

[45] Date of Patent: Dec. 15, 1998

[54] MOBILE TRACKING ANTENNA MADE BY SEMICONDUCTOR TECHNIQUE

[75] Inventors: Lawrence A. Wan, Malibu; Asad M. Madni, Los Angeles, both of Calif.

[73] Assignee: BEI Sensors & Systems Company, Inc., Sylmar, Calif.

[21] Appl. No.: 781,199

[22] Filed: Jan. 10, 1997

[51] Int. Cl.[6] ..... H01Q 3/00; H01Q 15/14

[52] U.S. Cl. ..... 343/757; 343/915; 343/916

[58] Field of Search ..... 343/757, 758, 343/761, 762, 763, 912, 914, 915, 916; H01Q 3/00, 15/14

[56] References Cited

U.S. PATENT DOCUMENTS 4,535,961 8/1985 Sobczak et al. ..... 343/915

4,750,002 6/1988 Kommineni ..... 343/915

5,063,389 11/1991 Reits ..... 343/915

*Primary Examiner*—Hoanganh T. Le

*Attorney, Agent, or Firm*—Jerry G. Wright; Flehr Hohbach Test Albritton and Hebert LLP

[57] ABSTRACT

A mobile tracking antenna for microwave signals from a satellite or distant transmitter includes a micro- electromechanical system produced by semiconductor processing. Specifically several micro faceted reflector segments have their facets selectively controlled by a feedback control system and reflects the signal onto a four sector horn which then by error signals actuates electrostatic positioning means on the micro facets to center the signal on the optimum receiving portion of the horn. Each segment covers a portion of the 360° receiving spectrum. The particular segment is selected by a maximum signal being received.

12 Claims, 4 Drawing Sheets

MOBILE TRACKING ANTENNA MADE BY SEMICONDUCTOR TECHNIQUE

The present invention is directed to a mobile tracking antenna for receiving microwave signals from a satellite or distant transmitter and more specifically to an antenna which forms a microelectromechanical system.

BACKGROUND OF THE INVENTION

In receiving microwave signals, for example from broadcast satellites where it is desired to use a mobile receiving antenna system the components of such a system are very costly. They may include a concave receiving dish typical of microwave antennas which is positioned both in elevation and azimuth by a motor and encoder system which by use of an electronic control device keeps the antenna tracking the satellite. In addition the mobile platform requires gyros and associated electronic circuitry/mechanical assemblies to stabilize it. With the proliferation of satellite systems, it is desirable to have a mobile tracking antenna which is at least an order of magnitude less costly.

OBJECT AND SUMMARY OF INVENTION

An object of the present invention is to provide an improved mobile tracking antenna.

In accordance with the above object there is provided a mobile tracking antenna for receiving microwave signals from a satellite or distant transmitter comprising at least one reflective microwave lens segment having a plurality of micro facets for controllably focusing and reflecting a received microwave signal from a satellite onto a microwave receiving horn. The horn is disposed opposite the reflective lens segment and has an optimum center of reception. Feedback control means responsive to the magnitude of received microwave signals reflected from the micro facets of the lens adjusts the azimuth and elevation angles of each of the facets to center reflected signals on the optimum center of reception of the horn means to track the microwave signal in real time from the mobile antenna.

DETAILED DESCRIPTION OF PREFERRED EMBODIMENTS

Figure 1:
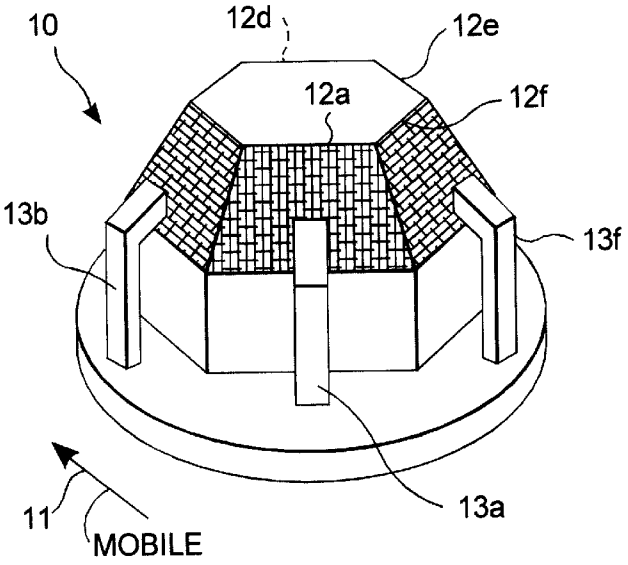
FIG. 1 is a perspective view of an antenna which is mounted on a mobile platform embodying the present invention.

FIG. 1 shows a mobile antenna 10, for tracking the microwave signals from satellites or distant transmitters, which would be mounted on some type of mobile platform such as a military vehicle, ship, truck or automobile with the platform not actually being shown but with the arrow 11 indicating that it is mounted on a mobile platform. The antenna includes several reflective microwave lens segments 12*a* through 12*f* (for example, six are illustrated) which are arranged in a quasi-conical format to provide a 360° angle of reception for the microwave signals. Each segment has a plurality of micro facets lying generally in a common plane (which will be described in greater detail) for controllably focusing and reflecting the received microwave signals from the satellite onto microwave receiving horns 13*a*–13*f* disposed opposite the respective lens segments 12*a*–12*f*. Although six segments are shown, other configurations are possible based on resolution and angle of reception. Also, although each segment is illustrated as planar, they could be curved.

Figure 2:
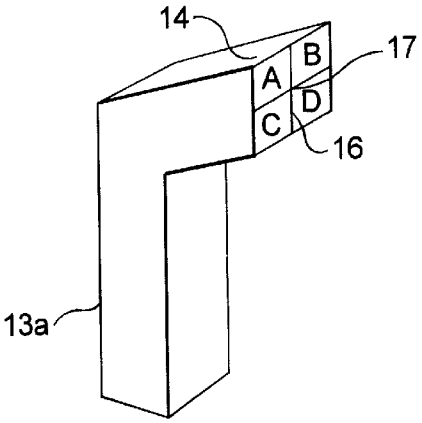
FIG. 2 is an enlarged perspective view of a receiving horn portion of FIG. 1.
Figure 12:
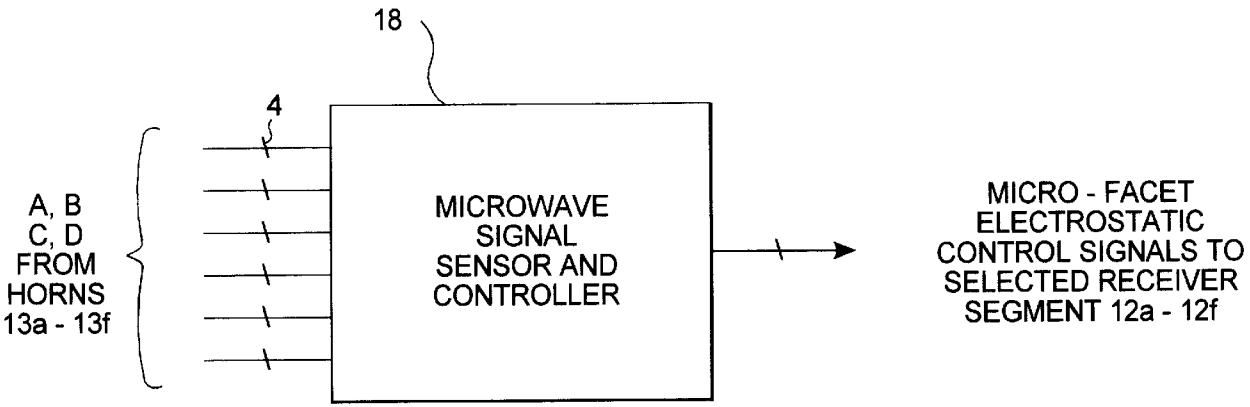
FIG. 12 is a block diagram showing the electrical signal processing components embodying the invention.

FIG. 2 illustrates a typical horn 13*a* which has its receiving end 14 divided into four sectors designated A, B, C, and D arranged around the orthogonal axis 16 which has a center or origin at its crossing point 17. This point is also the optimum center of reception for the horn 13*a* with respect to its particular associated reflective lens segment 12*a*. Referring briefly to FIG. 12, all six horns 13*a*–13*f* are connected to microwave signal sensor and controller 18 with four inputs each respectively related to A, B, C and D from each horn. By processing, to be described later, the sensor and controller unit 18 provides a feedback signal to center the received and reflected microwave signal onto optimum center of reception 17 of the selected horn.

Figure 3:
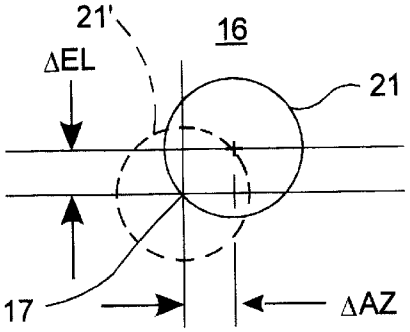
FIG. 3 is a diagram illustrating the operation of the present invention.

The result of the above feedback centering is shown in FIG. 3 where the axis 16 of the horn is illustrated along with its center 17. Initially it is assumed that the microwave signal as shown by the solid circle 21 is received and is offset from the elevation and azimuth null by $\Delta_{EL}$ and $\Delta_{AZ}$. The object of the invention is to shift to the dashed circle 21' so that the received microwave signal coincides with the optimum center of reception 17; i.e., with the $\Delta_{AZ}$ and $\Delta_{EL}$ errors approaching zero.

Figure 4A:
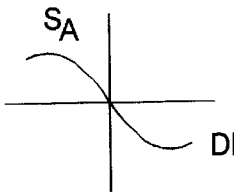
FIGS. 4A and 4B are characteristic curves illustrating the operation of FIG. 3.
Figure 4B:
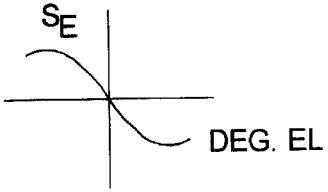

FIGS. 4A and 4B illustrate how the control system of the present invention responds to azimuth and elevation errors with signals $S_A$ or $S_E$. By sensing these errors, the feedback system adjusts the micro facets of the particular segment in question to center the reflector signal as illustrated in FIG. 3.

To accomplish the foregoing, the micro facets of a selected one of the individual segments 12*a* through 12*f* must be adjusted in synchronism. Moreover, to construct micro facets which can be easily controlled and still have necessary microwave optical properties, a microelectromechanical type of reflective lens must be provided using semiconductor micromachining processing.

Figure 5:
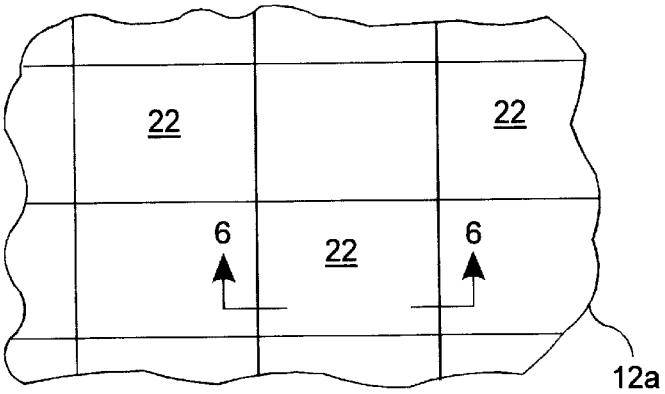
FIG. 5 is a plan view of a portion of a reflective surface of FIG. 1.

FIG. 5 illustrates, for example, a portion of the segment 12*a* where each facet is illustrated as shown at 22. Of course there would be hundreds of thousands of facets on a particular segment.

Figure 6:
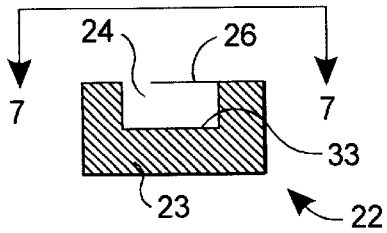
FIG. 6 is a cross sectional view taken substantially along line 6—6 of FIG. 5.

FIG. 6 is an idealized cross section of a single facet where it is in fact micro-machined from a wafer of silicon or a ceramic (or a plastic). Thus the cross sectional area shown at 23 might be silicon with the cavity 24 produced by etching to leave a single micro facet 26 cantilevered over the cavity from one of the walls of the cavity 24.

Figure 7:
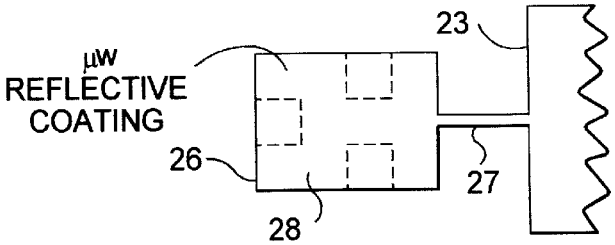
FIG. 7 is an enlarged plan view taken along line 7—7 of FIG. 6 illustrating one embodiment of the invention.

FIG. 7 is a planar plane view of FIG. 6 where the facet 26 is connected to the main body 23 by a thin leg portion 27. The top surface 28 of each facet 26 is coated with, for example, a metal such as aluminum or gold, or any conductive metal, which provides a reflective surface for the microwave signals.

Figures 8A, 8B:
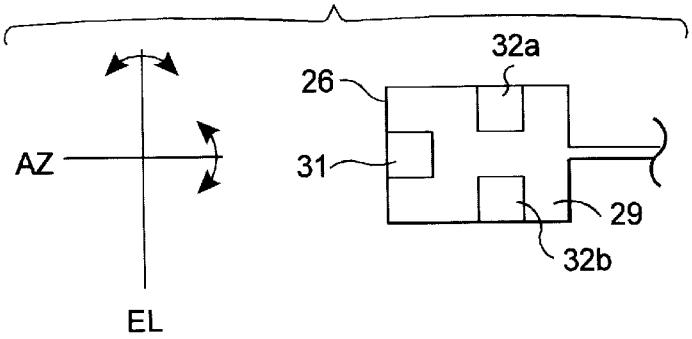
FIG. 8A is a plan view of an opposite side of FIG. 7.
FIG. 8B are axes illustrating the motion of FIG. 8A.
Figure 10:
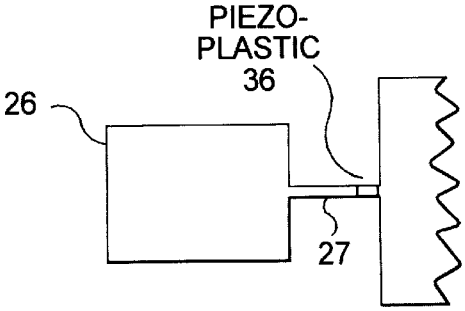
FIG. 10 is a plan view of an alternative embodiment of FIG. 7.

In order to controllably move the facet to provide for the azimuth and elevation corrections as indicated in FIG. 3, one technique is to provide on the backside 29 of each facet metal pads 31 and 32A and 32B. Then by matching pads designated with a corresponding prime on the bottom surface 33 of cavity 24, selective actuation of these conductive pads 31' and 32'A and 32'B from the control signal input shown at 34 provided by means of electrostatic action, a twisting of the facet 26 to control azimuth or bending to control elevation. (See FIG. 8B). Although a pair of pads 32A, 32B is shown, one pad might be sufficient. All of the foregoing can be provided by well known or integrated circuit processing techniques. Alternatively as shown in FIG. 10, rather than the electrostatic actuation, the leg 27 of the pad 26 can be connected by a piezo-plastic coupling 36 and driven by the control signals 34 to provide the same type of actuation.

Figure 9:
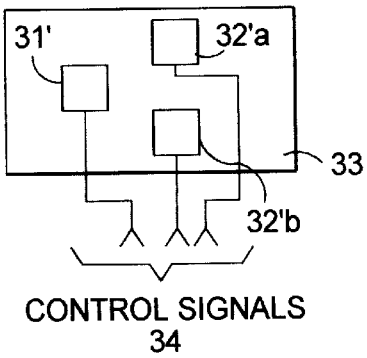
FIG. 9 is a plan view of a recessed portion of FIG. 6.
Figure 11:
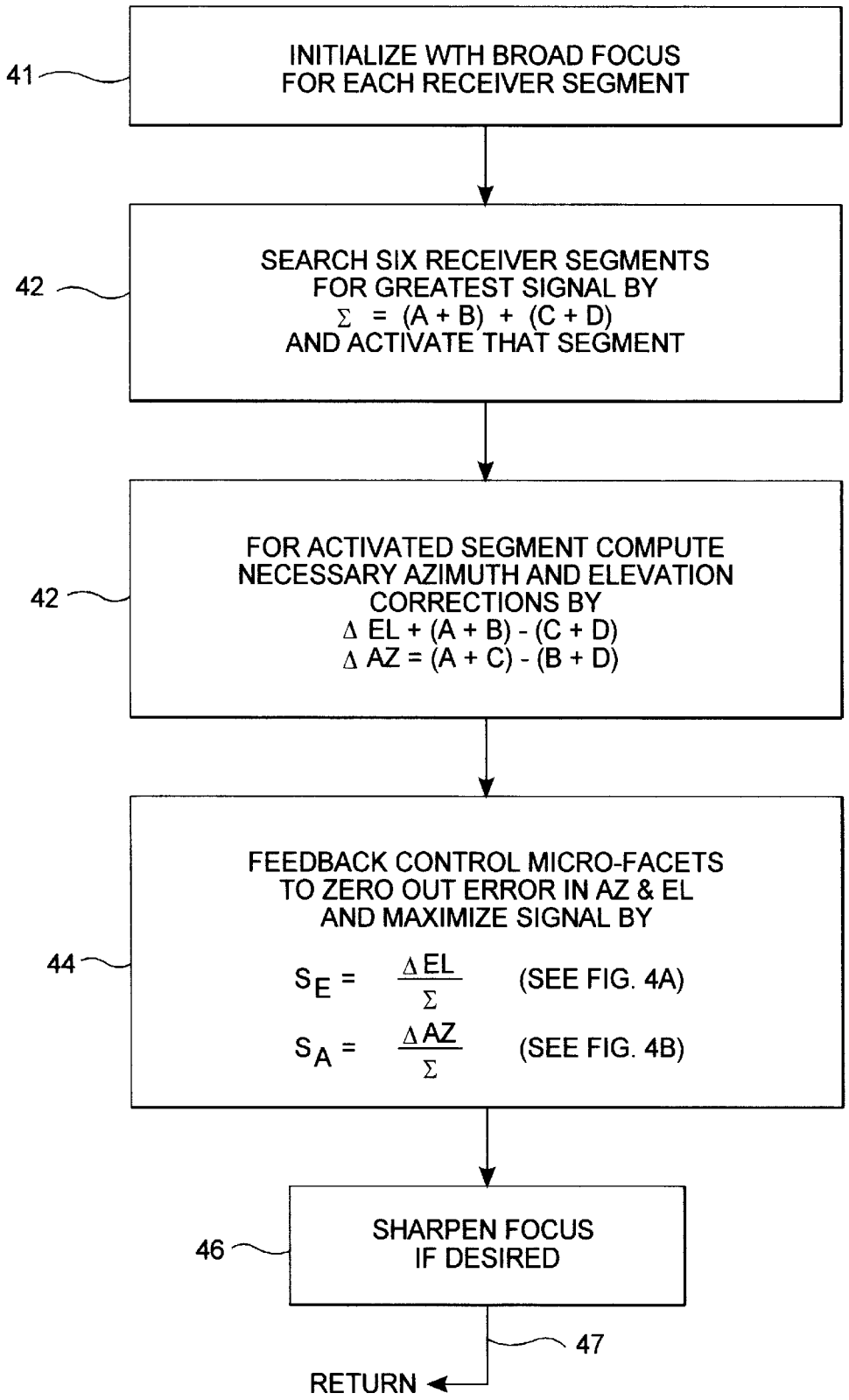
FIG. 11 is flow chart illustrating the operation of the invention.
Figure 13:
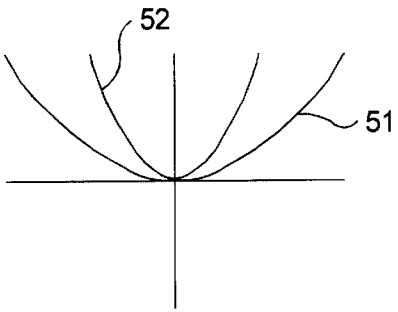
FIG. 13 are characteristic curves illustrating a function of the invention.

Thus the overall control technique for tracking (which inherently provides a stabilizing function also) of a satellite signal is illustrated in FIG. 11. First in step 41, each lens segment 12*a* through 12*f* is initialized with the broad focus step 42 and a search is made for the receiver segment receiving the greatest satellite signal by the technique of Equation 1. That segment is actuated. Equation 1 merely shows that the greatest signal magnitude is the addition of the sectors A through D. Then in step 43 for that activated segment there is computed the necessary azimuth and elevation corrections. These are equations 2 and 3 where for elevation correction A and B and C and D sectors of the horn 13*a* of FIG. 2 are differenced and for azimuth the A and C and Band D sectors are differenced. Then in step 44 error control signals $S_E$ and $S_A$ as shown in Figures a and b are derived by use of the Δ elevation and azimuth signals divided by the total summation signal are shown by equations 4 and 5. The application of these control signals by way of the control signal input 34 of FIG. 9 thus shifts the facets so that the received signal 21' as shown in FIG. 3 is now entered. Then in step 46, the focus may be sharpened if desired. This is done by applying additional control signals to the facets to provide a sharper focus as illustrated in FIG. 13 where 51 shows a broad focus and 52 a narrow focus.

To explain the controlled movement of the facets of each segment in greater detail, each facet will be moved with reference to its adjacent facets either linearly or non-linearly so that the composite facets focus the signal toward the center of the horn thereby achieving the best null for the azimuth and elevation error signals. In general, and referring for example to segment 12*a,* if the segment is divided into upper and lower halves, the upper half facets will have a negative gradient and the lower half facets a positive gradient. Similarly if the segment is divided into left and right halves, there will be positive and negative gradients respectively. In order to provide for real time tracking, at 47 a return is made to initialize step 41 or more realistically step 42. Thus real time tracking and also stabilization is provided. Once tracking is effected by the null process of $S_E$ and $S_A$ then the sum signal (Equation 1) is maximized. The transmitted information of the sum signal is then demodulated by the receiver.

The microelectromechanical system thus provided by semiconductor micromachine processing is more economical to produce, especially in comparison to the brute force techniques of the past and moreover, especially for high reliability, are very robust and durable.

Thus an improved mobile tracking antenna has been provided.

EQUATIONS $$\Sigma = (A + B) + (C + D) \tag{1}$$

$$\Delta_{EL} = (A + B) - (C + D) \tag{2}$$

$$\Delta_{AZ} = (A + C) - (B + D) \tag{3}$$

$$S_E = \frac{\Delta_{EL}}{\Sigma} \tag{4}$$

$$S_A = \frac{\Delta_{AZ}}{\Sigma} \tag{5}$$

What is claimed is:

1. A mobile tracking antenna for receiving microwave signals from a satellite or distant transmitter comprising:

at least one reflective microwave lens segment having a plurality of micro facets for controllably focusing and reflecting a received microwave signal from said satellite or distant transmitter onto a microwave receiving horn means disposed opposite said reflective lens segment, said horn means having an optimum center of reception;

feedback control means responsive to the magnitude of received microwave signals reflected from said micro facets of said lens for adjusting the azimuth and elevation angles of each of said facets to center reflected signals on said optimum center of reception of said horn means to track said microwave signals in real time from said mobile antenna.

2. A mobile tracking antenna as in claim 1 where said feedback control means provides for focusing of said microwave signals with respect to said horn means.

3. A mobile tracking antenna as in claim 1 where said microwave lens has its micro facets formed by semiconductor micromachining processing techniques.

4. A mobile tracking antenna as in claim 3 where said microwave lens segment is composed of any one of the following three materials: silicon, ceramic, or plastic.

5. A mobile tracking antenna as in claim 3 where a silicon wafer is etched to form a cavity with a said facet cantilevered over said cavity.

6. A mobile tracking antenna as in claim 1 including a plurality of said segments arranged in a quasi-conical format to provide a 360° angle of reception of said microwave signals.

7. A mobile tracking antenna as in claim 6 including means for selecting one of said plurality of segments receiving a said microwave signal having the greatest magnitude.

8. A mobile tracking antenna as in claim 1 where each of said micro facets has a conductive surface whereby said microwave signals are reflected.

9. A mobile tracking antenna as in claim 1 where said horn means has four sectors arranged around an orthogonal axis, the origin of said axis being said optimum center of reception.

10. A mobile tracking antenna as in claim 1 where each of said facets has its azimuth and elevation controlled by electrostatic means which are driven by said feedback control means.

11. A mobile tracking antennas as in claim 10 where said electrostatic means includes metallized pads on each of said facets which are juxtaposed with fixed metallized pads serving as effective capacitors to provide said electrostatic forces for said azimuth and elevation control.

12. A mobile tracking antenna as in claim 1 where each of said facets has its azimuth and elevation controlled by a piezo-plastic coupling driven by said feedback control means.

* * * * *